US006052865A

United States Patent [19]

Schwarze et al.

[11] Patent Number: 6,052,865

[45] Date of Patent: Apr. 25, 2000

[54] AIR BRUSH VACCUM-FAN GUTTER BROOM

[75] Inventors: Mark Robert Schwarze; Anthony C. Libhart, both of Huntsville, Ala.

[73] Assignee: Schwarze Industries, Inc., Huntsville, Ala.

[21] Appl. No.: 09/085,502

[22] Filed: May 27, 1998

Related U.S. Application Data

[60] Provisional application No. 60/047,760, May 27, 1997.

[51] Int. Cl.[7] ..... E01H 1/08; E01H 1/04; E01H 1/05

[52] U.S. Cl. ..... 15/385; 15/87; 15/180; 15/340.4

[58] Field of Search ..... 15/87, 180, 340.3, 15/340.4, 383, 385, 387

[56] References Cited

U.S. PATENT DOCUMENTS

| | | | |
|---|---|---|---|
| 1,093,820 | 4/1914 | Beach | 15/385 X |
| 1,763,365 | 6/1930 | Nobbs | 15/385 X |
| 2,415,372 | 2/1947 | Salt et al. | 15/385 X |
| 2,933,752 | 4/1960 | McLennon | 15/385 X |
| 4,731,956 | 3/1988 | Wood | 15/385 X |
| 5,392,492 | 2/1995 | Fassauer | 15/385 X |

FOREIGN PATENT DOCUMENTS

| | | | |
|---|---|---|---|
| 723168 | 1/1993 | France | 15/385 |
| 551107 | 5/1932 | Germany | 15/385 |

*Primary Examiner*—Mark Spisich
*Attorney, Agent, or Firm*—Wallace G. Walter

[57] ABSTRACT

A gutter broom (8) for a pavement sweeper is defined by an annular brush disc (24) having a central opening and from which a series of equi-spaced conventional bristle blocks (11) are removably secured. A downwardly depending air foil (18) is secured to the underside of the annular brush disc (24) between each bristle block (11). A series of equi-spaced radially aligned fan blades (17) are secured to the opposite side of the annular brush disc (24) and function to define a radial flow fan. A stationary fan scroll (20) is formed over and contains the radial flow fan and includes an air flow outlet (23). When the gutter broom (8) is rotated, the air foils (18) function to draw ambient air and any entrained dust/debris into the brush structure with the resultant air streams directed to the radial fan structure, which, in turn, directs the dust/debris laden air stream to the outlet (23).

31 Claims, 7 Drawing Sheets

AIR BRUSH VACCUM-FAN GUTTER BROOM

CROSS REFERENCE TO RELATED APPLICATIONS

The present application claims domestic priority to U.S. Provisional Patent Application Ser. No. 60/047,760, filed May 27, 1997, the disclosure of which is incorporated herein by reference.

BACKGROUND OF THE INVENTION

The present invention relates to gutter brooms of the type used in pavement sweeping machines and, more particularly, to gutter brooms that minimizes the amount of dust or debris that is caused to become airborne as a result of the operation of the broom.

Pavement sweepers of the type used to sweep municipal streets typically include rotatable circular brooms that are designed to engage the pavement at the intersection of the pavement and the curbstone, i.e., the gutter. The sweepers typically include a gutter broom mounted on each side and rotatably controlled to move the accumulated dust/debris into the path of a primary vacuum intake hood that moves the debris into a containment bin. Since the rotating and forwardly moving gutter brooms are the first portion of the pavement sweeper to come into contact with the accumulated dust and debris, the rotating gutter brooms typically stir-up substantial amounts of dust and cause that dust to become airborne. In general, dust that is made airborne by the gutter broom(s) is not picked-up by the pavement sweeper and escapes the sweeping operation. Additionally, the airborne dust tends to eventually settle over a large area, depending, of course, on the temperature, humidity, and prevailing wind conditions.

Historically, pressurized water is sprayed onto the dust and debris accumulated in the gutter in an effort to suppress the quantity of dust that becomes airborne. Although atomized water sprays are generally effective in reducing the amount of airborne dust, the water sprays do not eliminate or reduce the airborne dust to minimal levels. In recent years, governmental regulations have been proposed that set upper limits on the amount of airborne dust that is associated with the process of sweeping pavement using mechanized sweepers. These standards necessitate that the amount of dust and debris that is made airborne and not captured by the sweeping process be minimized.

SUMMARY OF THE INVENTION

In view of the above, it is an object of the present invention, among others, to provide a gutter broom for pavement sweepers that has increased sweeping efficiency.

It is another object of the present invention to provide a gutter broom that is effective to capture the maximum amount of dust and debris while minimizing the fraction of dust and debris that is lost to the sweeper.

It is still another object of the present invention to provide a gutter broom for use with pavement sweepers that include air handling vanes that create air streams that are directed inwardly of the gutter broom to draw in air and any entrained dust or debris in the immediate vicinity of the gutter broom.

In view of these objects, and others, the present invention provides a gutter broom for use in pavement sweepers in which the broom is provided with air handling air foils/blades that are effective to draw surrounding air and any entrained dust/debris into the interior regions of the broom and re-direct those air streams to capture as high a fraction of the dust/debris as possible.

In its most general form, the gutter broom includes conventional ground-engaging bristles with air foils adjacent the bristles to create inwardly directed air flows. The air flows are re-directed through the center of the broom to a fan blade structure that further increases the flow rate and directs the air stream to other portions of the pavement sweeper for removal of the entrained dust and debris.

In a preferred from, the gutter broom includes an annular plate from which bristle segments and intermediate air foils depend. When the gutter broom is rotating, the air foils create inwardly directed air streams that are moved to and through a central opening in the annular plate. The annular plate includes upstanding radial fan blades that further accelerate the air streams though a fan cowling or shroud to an outlet to direct the dust and debris laden air flow to another part of the pavement sweeper for removal of the entrained dust and debris.

The present invention advantageously provides an air brush vacuum-fan gutter broom that has increased efficiency for removing dust and debris from a pavement while minimizing the quantity of dust and debris and is lost to the sweeping process.

Other objects and further scope of applicability of the present invention will become apparent from the detailed description to follow, taken in conjunction with the accompanying drawings, in which like parts are designated by like reference characters.

DESCRIPTION OF THE PREFERRED EMBODIMENT

Figure 1:
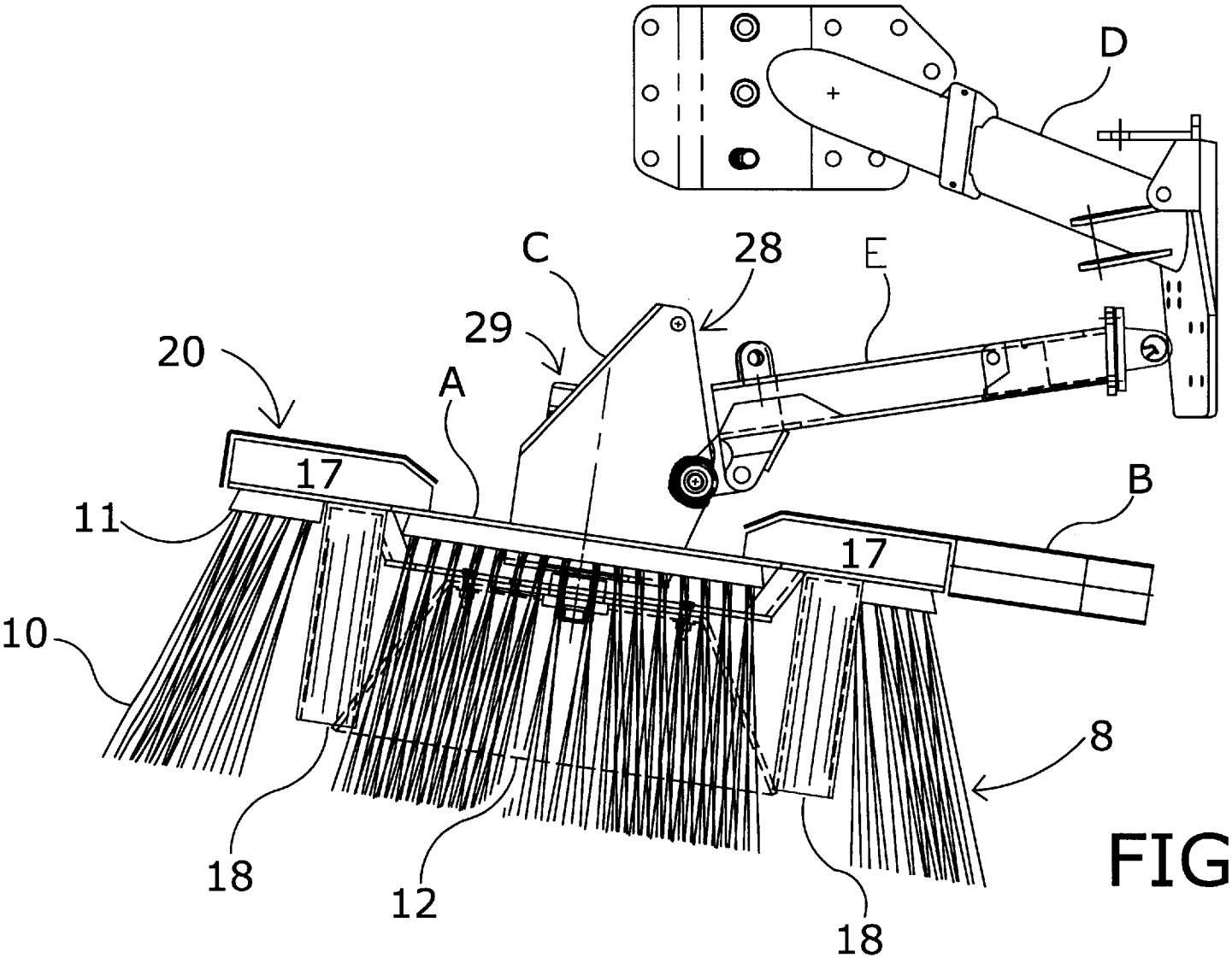
FIG. 1 is a schematic side view of a gutter broom having a radial-bladed fan integral with the top surface of a brush plate structure in accordance with the present invention.
Figure 2:
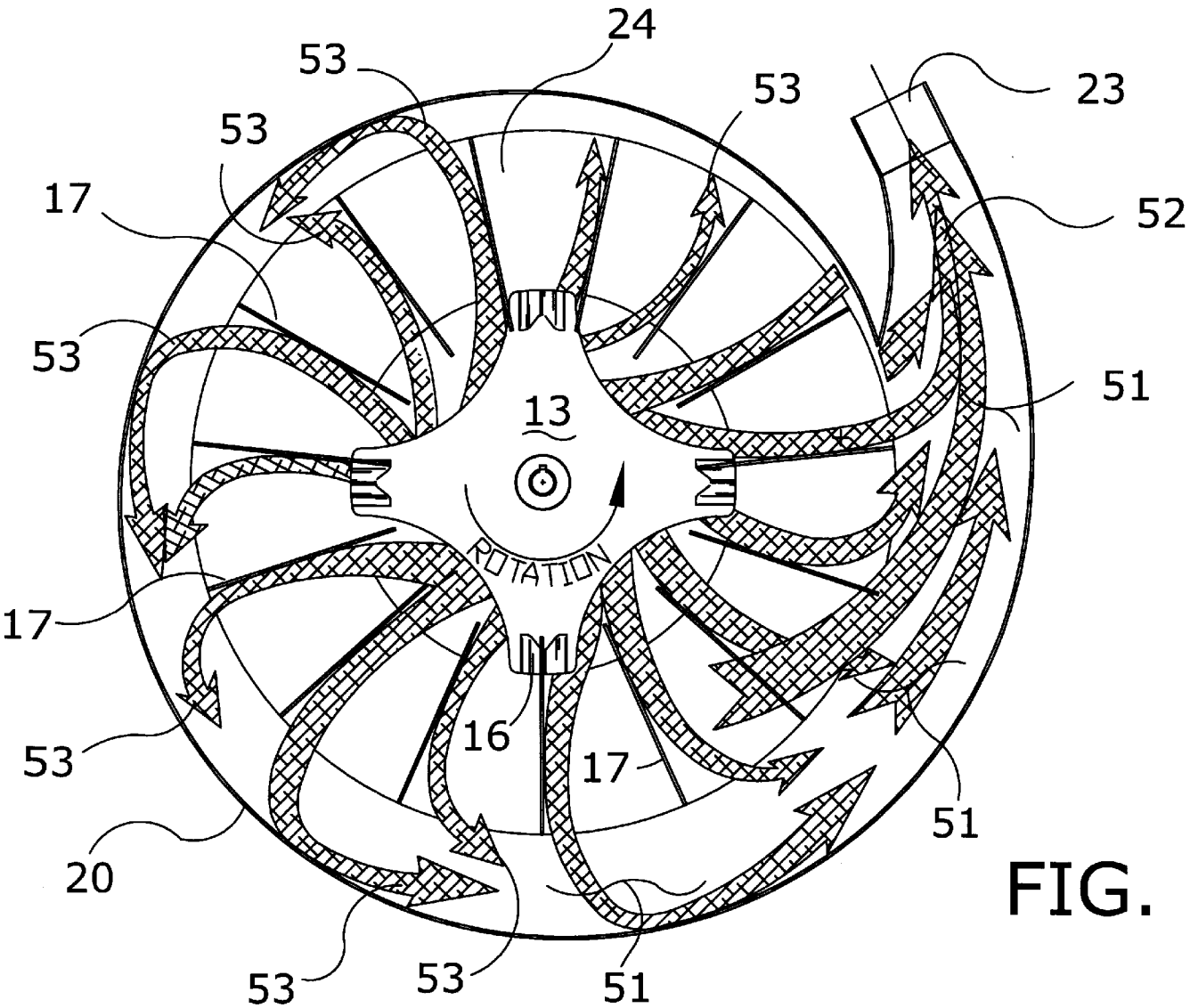
FIG. 2 is a top plan view showing the brush's fan fins and a blower housing shroud fitted above and circumjacent to the brush disc.
Figure 3:
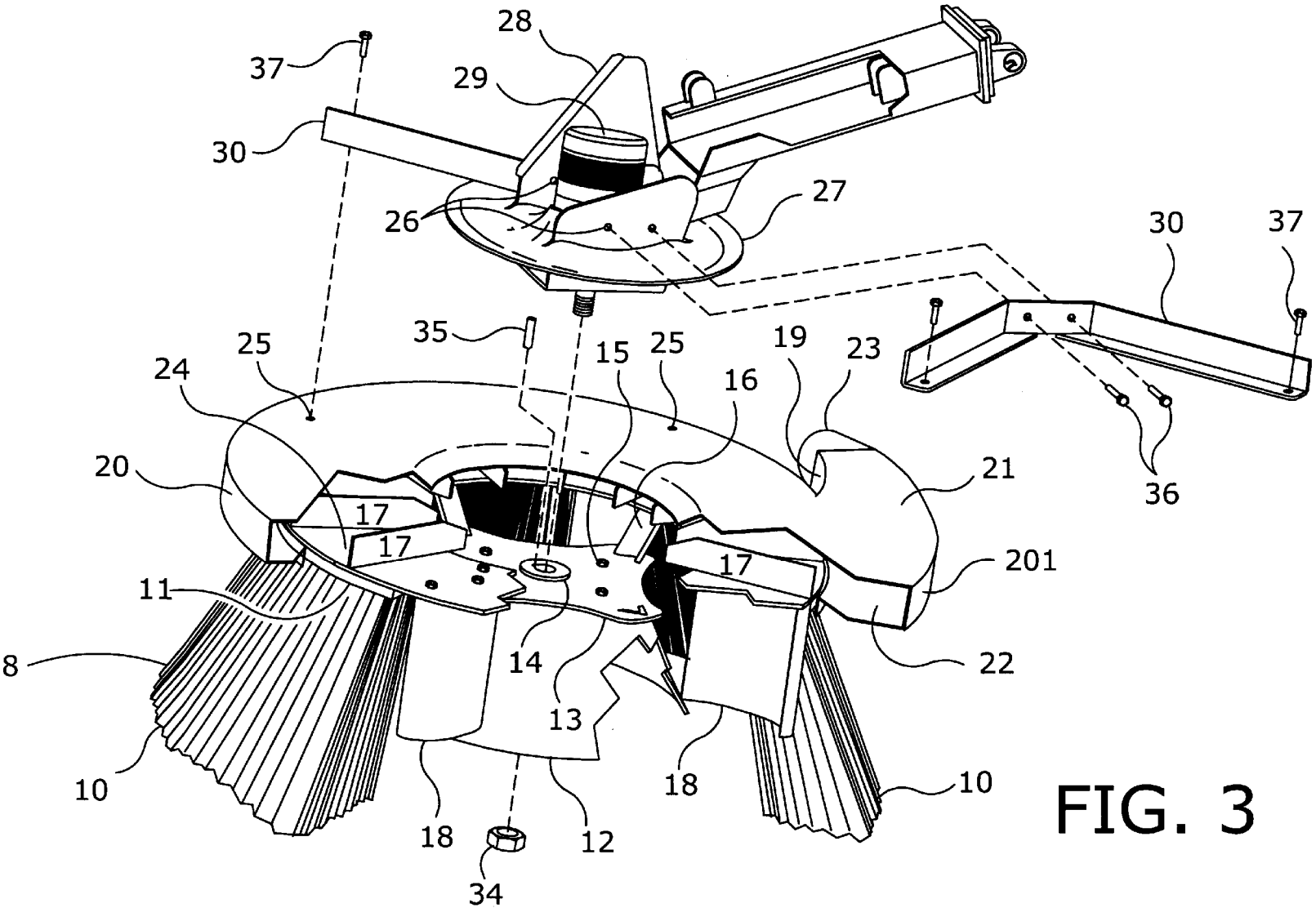
FIG. 3 is a perspective view showing a cross section of the broom and blower components including the outlet of the blower housing with selected parts broken-away for reasons of clarity.
Figure 4:
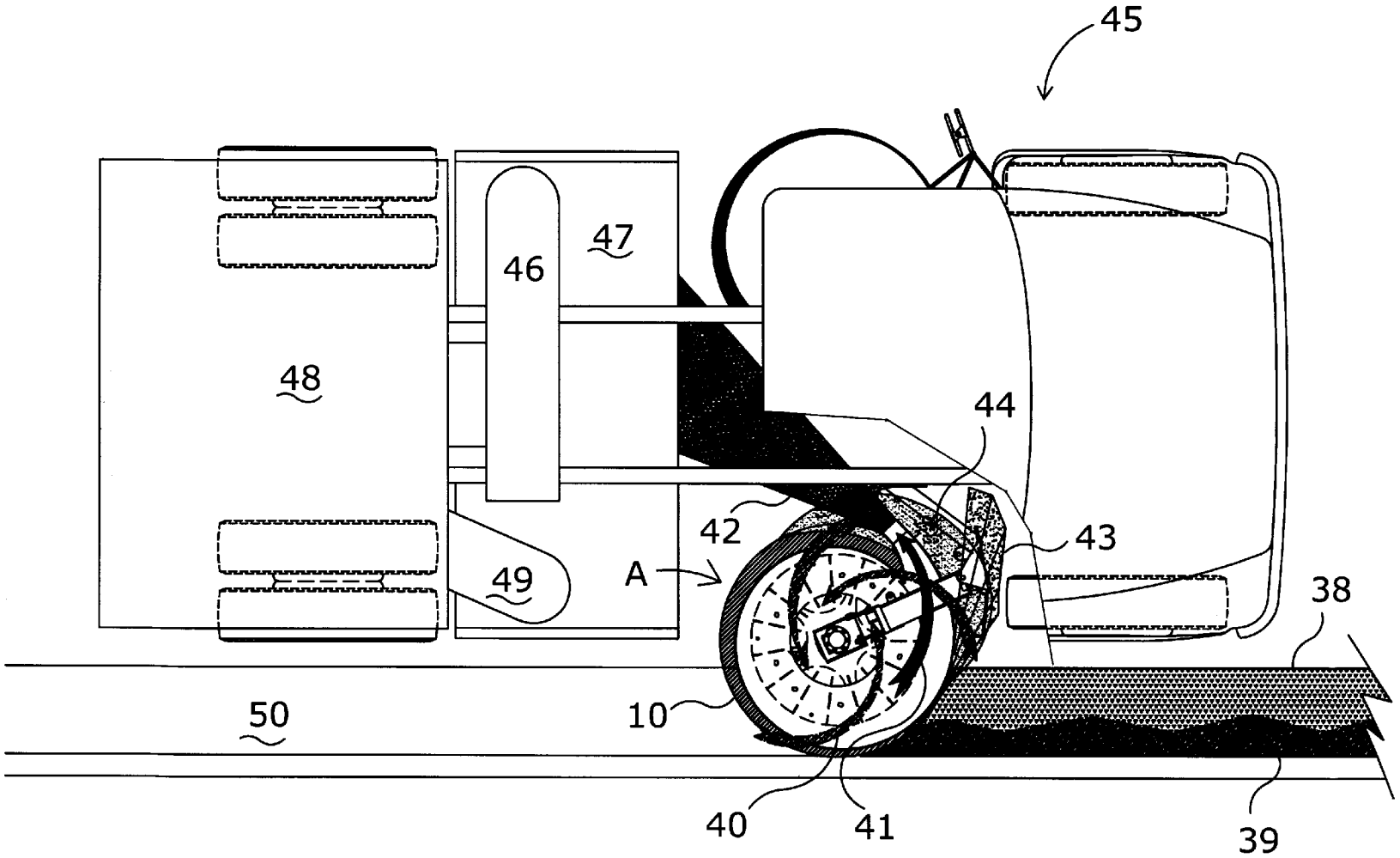
FIG. 4 is a top plan view of an exemplary pavement sweeper equipped with a gutter broom, showing debris and dust swept out of the gutter and guided into a central zone along the medial axis of the sweeper.

A gutter broom assembly in accordance with the present invention is shown in FIGS. 1 to 3 and installed on an exemplary truck-mounted pavement sweeper in FIG. 4 and designated generally by the reference character "A." The gutter broom assembly "A" is typically mounted to a commercial pavement sweeper of the type that also includes vacuum aspiration of dust-laden intake air and dustseparation and collection facilities. The exemplary pavement sweeper shown in FIG. 4 is representative of sweepers commercially available from Schwarze Industries, Inc. of Huntsville Ala. including models from the A6000 and A7000 series and similar Schwarze sweepers that are designed to fit onto commercially available automotive trucks including Ford CF-7000, Ford LN-7000, Ford F-700D, Navistar N-4700, Isuzu/GM W-7, GMC TIPKICK and similar vehicles.

As shown in the plan view of FIG. 4, the truck-mounted pavement sweeper 45 includes a gutter broom assembly "A" adjustably mounted on each side of the pavement sweeper 45, a vacuum intake hood 47 extending across the lateral or transverse axis of the pavement sweeper 45 for accepting debris directed generally along a pathway 42 from the gutter broom assembly "A", a fan 46 for generating a suction airflow through the vacuum intake hood 47, a debris containment bin 48, and a debris-transfer tube 49 for moving air-entrained debris/dust from the vacuum intake hood 47 into the debris containment bin 48. While not specifically illustrated, the pavement sweeper 45 includes devices that separate the air entrained debris/dust from the debris/dust stream and deposit the separated debris/dust in the containment bin 48 while recirculating and/or exhausting air from which the debris/dust is separated. The organization of the components of the pavement sweeper 45 illustrated in FIG. 4 is merely illustrative and numerous variations are possible including the use of a transversly cylindrical broom (not shown) mounted in or adjacent the vacuum intake hood 47. During normal operation, the gutter broom assembly "A" is lowered into controlled engagement with the curb and gutter area 50 of the paved street surface and rotated in a counterclockwise direction to impart kinetic energy to the accumulated dust 38 and debris 39 in the curb and gutter area 50 and cause that dust and debris 39 to be entrained within a flow stream 42 that is directed to the vacuum intake hood 47. As explained in more detail below, the gutter broom assembly "Al" includes airfoils that serve to create an airflow from the exterior environment of the gutter broom assembly "A" to the interior thereof; that airflow effectively entrains a portion of the dust/debris in the immediately adjacent dust and debris fields and directs that dust/debris through a central opening in the gutter brush to an outlet for further processing.

As shown in FIGS. 1–3, the gutter broom assembly "A" is attached to a support surface(s) of the pavement sweeper 45 through a mounting bracket, generally indicated at "D," a swing arm assembly "E," and a motor support bracket assembly "C." The mounting bracket "D," the swing arm assembly "E," and the motor support bracket assembly "C" are of a conventional or known design and allow the gutter brush assembly "A" to be lowered from an upper 'stowed' position to a lower, operative position and to be pivoted laterally outward from the body portion of the pavement sweeper 45 to engage the curb and gutter area 50 of the paved street. The motor support bracket assembly "C" includes a drive motor 29 (such as an hydraulic motor) having a downwardly extending output shaft (unnumbered) that connects to a spider plate 13 of the gutter broom 8 as explained below. A circular seal 27 (fabricated from an elastomeric material) is mounted at the lower end of the motor bracket 28 for engagement with a fan scroll 20 as described below. As can be appreciated, various known control devices, including hydraulic cylinders, springs, and dampers can be used to control the deployment of the gutter broom assembly "A."

Figure 6:
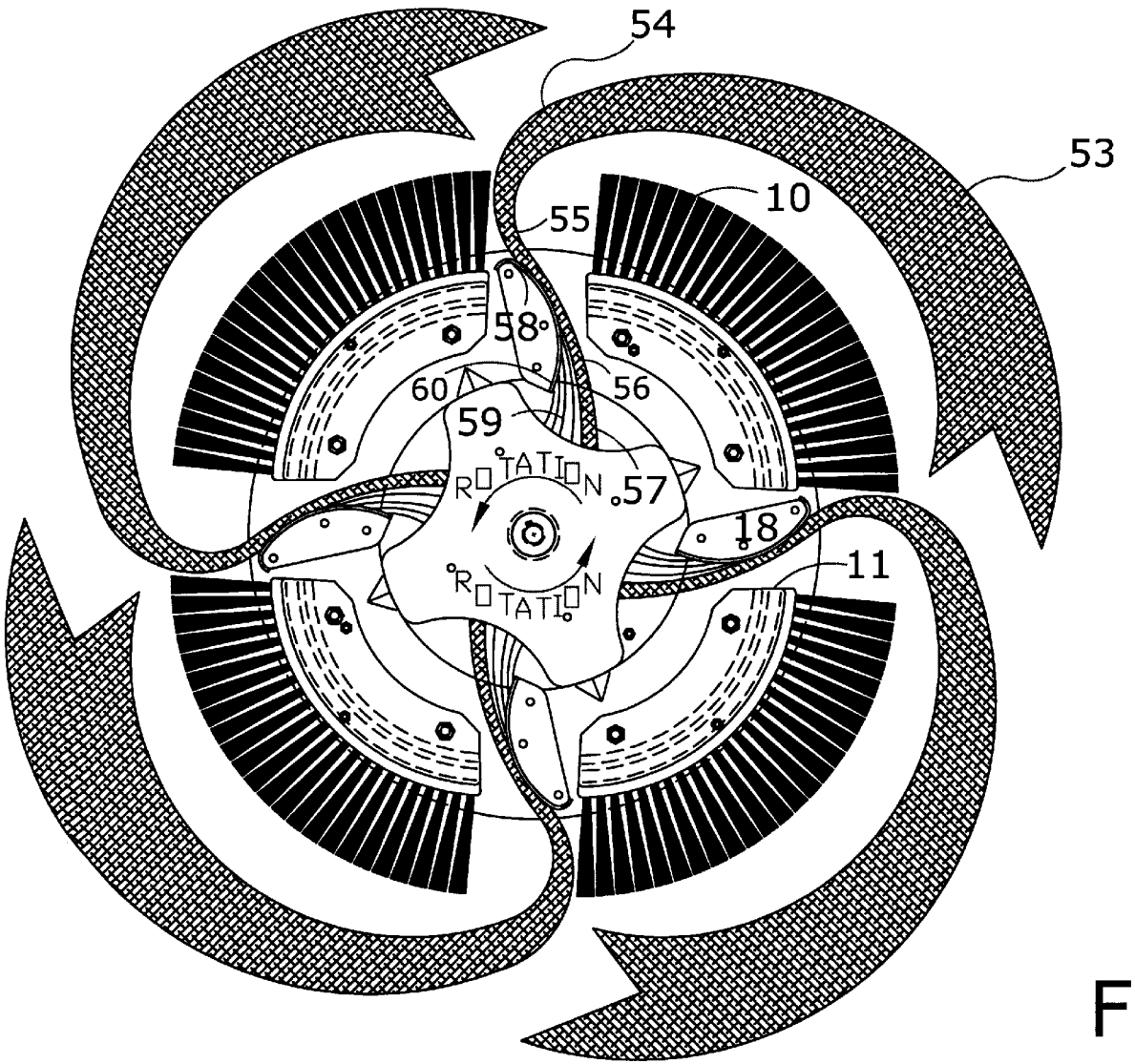
FIG. 6 is a bottom view of the gutter broom showing the inwardly directed air flow pattern.

The gutter broom, designed generally by the reference character 8, is fabricated from an annular brush disc 24 that defines a central opening or hole (unnumbered) through which dust and debris are removed as explained below. A series of conventional bristle blocks 11 are removably secured to the bottom side of the annular brush disc 24 by threaded fasteners (unnumbered) and include downwardly and outwardly extending metal or plastic bristles 10. As best shown in FIGS. 1 and 6, four bristle blocks 11 are equispaced about the underside of the annular brush disc 24 with an interblock space or opening (unnumbered) defined between bristle blocks 11. As explained below, the four interblock openings function as air inlets to allow an inwardly directed flow of dust- and debris-laden air into the interior of the gutter broom 8.

Figure 8:
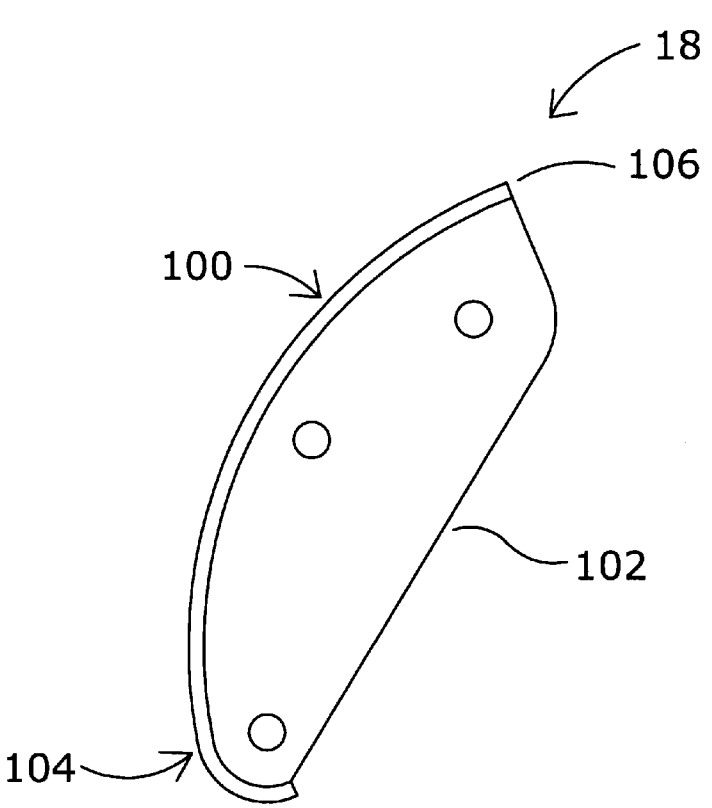
FIG. 8 is an enlarged detail of the profile of a representative air foil.
Figure 7:
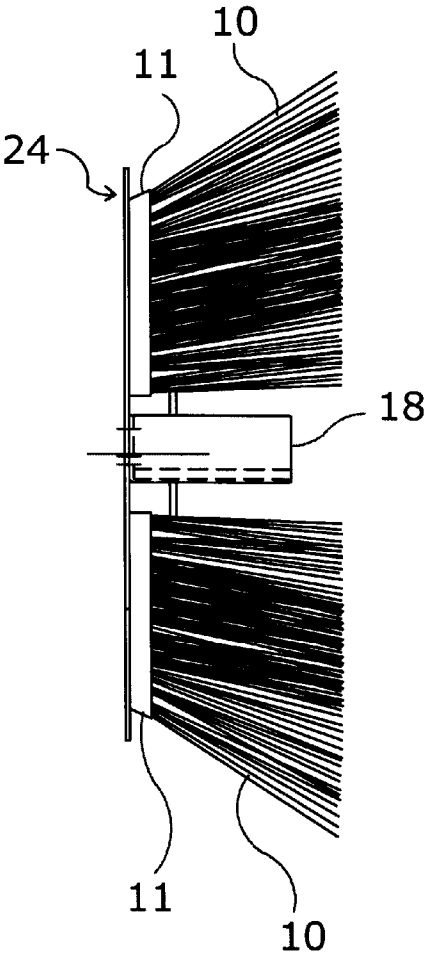
FIG. 7 is a side view of the gutter broom of FIG. 6.

A downwardly depending airfoil 18 is secured to the underside of the annular brush disc 24 in each interblock space. As shown in the enlarged detail of FIG. 8, each airfoil 18 includes a curvilinear surface 100, a bottom surface 102, a leading edge surface 104, and a trailing edge 106. When the gutter broom 8 is rotated in the counterclockwise direction shown in FIG. 6, the airfoils 18 serve to induct air (and any entrained dust or debris) inwardly through the interblock spaces.

As best shown in FIGS. 2 and 3, a series of equi-spaced radially aligned fan blades 17 are secured (for example, by welding) to the upper side of the annular brush disc 24. The fan blades 17 function to define a radial flow fan, i.e., air flow (and any entrained dust/debris) are directed radially outwardly by the fan blades 17 from the center opening.

As best shown in FIG. 3, a spider plate 13 is centrally located with the central opening and spaced downwardly from the plane of the annular brush disc 24 and held in that position by four standoffs 16 to define air entry spaces (unnumbered) between each standoff 16 and the respective planes of the annular brush disc 24 and the spider plate 13. An air deflector cup 12, which can be characterized as an upwardly converging and truncated cone, is secured to the underside of the spider plate 13. The air deflector cup 12 serves to re-direct and guide the inwardly directed air flows provided via the air foils 18 upwardly toward the central opening of the annular brush disc 24. A drive bushing 14 is located in the rotational center of the spider plate 13 and connects to the output shaft (unnumbered) of the hydraulic drive motor 29 via a key 35 and locking nut 34 in the usual manner.

The upper portion of the gutter broom 8 is contained within a stationary fan scroll, generally indicated at 20.

As best shown in FIG. 3, the fan scroll 20 is defined by spaced top and bottom plates 21 and 22 connected at the outer peripheries by a connecting wall 201. The bottom plate 22 has a circular opening therein of sufficient diameter to receive the annular brush disc 24 with a clearance fit therebetween to allow rotation of the gutter broom 8. The top plate 21 includes an opening somewhat smaller than that of the circular seal 27 attached to the lower portion of the motor bracket 28. When the gutter broom 8 is secured to the motor bracket 28, (i.e., when the motor shaft is secured to the spider plate 13 with the nut 34), the circular seal 27 contacts the top plate 21 in sealing engagement therewith so that any air leakage (and any entrained dust/debris) from the interior volume of the fan scroll 20 is avoided. Additionally, two attachment brackets 30 (one on each side of the motor bracket 28) assist in securing the fan scroll 20 to the motor support bracket assembly "C."

Figure 5:
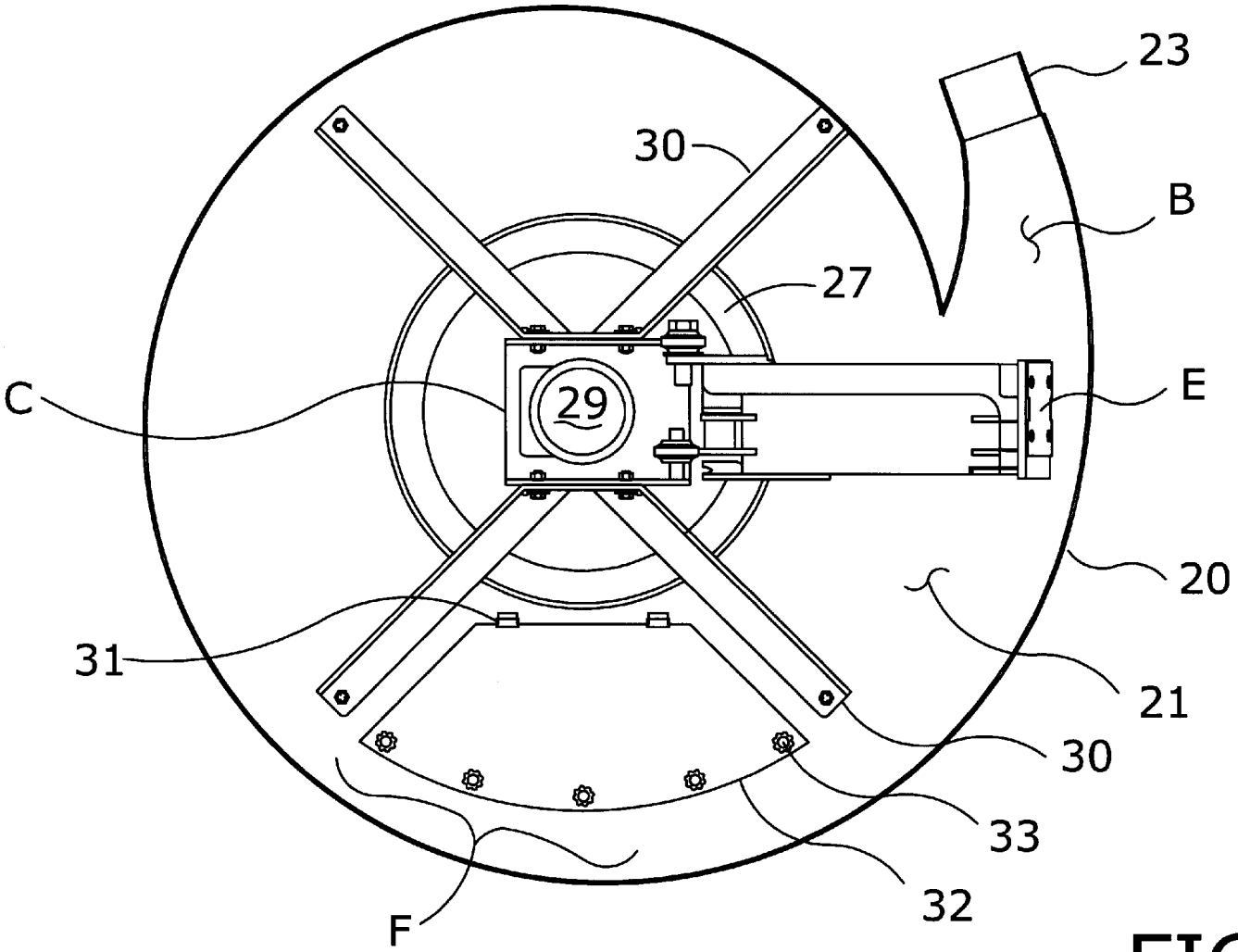
FIG. 5 is a top plan view showing the housing attachment brackets supporting the housing by its attachment to the motor bracket and showing a hatch that allows access to the broom bristle attachment bolts.

A sector shaped access hatch 32 is mounted to the top plate 21 and serves to cover an access port (not shown) that allows access to the upper surface of the annular brush disc 24 for the purpose of removing/installing threaded fasteners that secure the brush blocks 11 to the underside of the annular brush disc 24. As shown in the top view of FIG. 5, the access hatch 32 is hinged at 31 and held in place in its closed position by fasteners 33. As is also shown in FIG. 5, the fan scroll 20 includes a conventional outlet configuration by which the top plate 21, the bottom plate 22, and the sidewall 201 are configured to define a outlet path of diminishing cross-sectional area that terminate in an outlet tube 23. The outlet tube 23 can be connected, depending upon the particular design, to a flexible duct or a rigid duct that directs the dust/debris stream into the vacuum intake hood 47. If desired, the output tube 23 can merely direct its outlet air stream toward and to the vacuum intake hood 47.

The gutter broom 8 can be viewed as a bi-stage fan combination in which the airfoils 18 depending from the annular brush disc 24 in the interblock spaces function to draw air and any entrained dust/debris into and between the interblock spaces. As shown in FIG. 6, plural air streams 53 having sections 54, 55, and 56 are created by the airfoils 18 moving through the ambient air mass as the gutter broom 8 is rotated by its motor 29. A portion of the dust and debris fields created by the bristles 10 rubbing against dust 38 and debris 39 is drawn into the various air streams 53 and pass across or over the curvilinear surface 100 of the airfoil 18 toward the center of the rotating annular brush disc 24. As the respective air streams move across the curvilinear surface 100 of the respective air foil 18 (at region 55), each air stream 53 is accelerated to an increased velocity in the area designated at 56 in FIG. 6 and a partial vacuum is created in area 59. The air stream then flow axially upward against the conically converging surface of the air deflector cup 12 into and through the spaces between the standoffs 16 and through the center opening of the annular brush disc 24. Thereafter, the air flow changes direction to a radially outward direction (as shown in FIG. 2) with the radial blades 17 located on the upper surface of the annular brush disc 24 accelerating the air streams radially outward into and to the periphery of the fan scroll with the air stream converging and passing through the outlet 23.

The present invention advantageously provides an air brush vacuum-fan gutter broom that has increased effectiveness in pneumatically capturing dust and debris from the dust and debris fields generated consequent to operation of the gutter broom. The dust- and debris-laden air from the immediate vicinity of the rotating broom are drawn into the interior of the broom where the air stream is re-directed to an outlet for further processing in the pavement sweeper.

As will be apparent to those skilled in the art, various changes and modifications may be made to the illustrated air brush vacuum-fan gutter broom of the present invention without departing from the spirit and scope of the invention as determined in the appended claims and their legal equivalent.

What is claimed is:

1. A gutter broom for a pavement sweeper comprising:

a base plate mounted for rotation about an axis of rotation;

means defining a brush having a plurality of bristles extending from one side of said base plate; and a plurality of air foils interspersed with said bristles for forming an inwardly directed air flow in response to rotation of the broom.

2. The gutter broom of claim 1 wherein said base plate has central opening therethrough, whereby the inwardly directed air flow passes through the central opening in response to rotation of the gutter broom about the axis of rotation.

3. The gutter broom of claim 2, further comprising an air flow redirector for redirecting the inwardly directed air flow through the central opening of said base plate.

4. The gutter broom of claim 3, wherein said air flow redirector comprises a conical body of revolution having a narrow end and a wide end, the narrow end nearer the central opening than the wide end.

5. The gutter broom of claim 3, further comprising a spider plate spaced from the base plate to define an air flow passage between the spider plate and the base plate, said air flow redirector connected to said spider plate.

6. The gutter broom of claim 1, wherein said air foils are connected to said base plate and depend therefrom.

7. The gutter broom of claim 1, wherein said air foils are defined by a curvilinear surface having a leading edge and a trailing edge, said trailing edge nearer the axis of rotation than the leading edge.

8. The gutter broom of claim 1, further comprising a plurality of air handling blades connected to said base plate on the side opposite said air foils for directing the air flow therefrom.

9. The gutter broom of claim 8, further comprising a fan housing surrounding said air handling blades and having a outlet through which the air flow is directed.

10. A gutter broom for a pavement sweeper comprising:

an annular base plate mountable for rotation about an axis of rotation and having an opening therein;

means defining a plurality of bristles extending from one side of said base plate;

a plurality of first air handling blades on the surface of the base plate opposite the side from which the bristles extend from for forming an airstream directed therefrom and a plurality of second air handling blades interspersed with said bristles for forming an inwardly directed air flow in response to rotation of the bristles the inwardly directed air flow passing through the opening in the base plate.

11. The gutter broom of claim 10 wherein the opening is formed in the central portion of said base plate.

12. The gutter broom of claim 11, further comprising an air flow redirector for redirecting the inwardly directed air flow through the central opening of said base plate.

13. The gutter broom of claim 12, wherein said air flow redirector comprises a conical body of revolution having a narrow end and a wide end, the narrow end nearer the central opening than the wide end.

14. The gutter broom of claim 10, further comprising a spider plate spaced from the base plate to define air flow passages between the spider plate and the base plate.

15. The gutter broom of claim 10, wherein said second-mentioned air handling blades are connected to said base plate and depend therefrom.

16. The gutter broom of claim 10, wherein said second-mentioned air handling blades are defined by a curvilinear surface having a leading edge and a trailing edge, said trailing edge nearer the axis of rotation than the leading edge.

17. The gutter broom of claim 10, further comprising a fan housing surrounding said first-mentioned air handling blades, said fan housing having a outlet through which the air flow is directed.

18. A gutter broom for a pavement sweeper comprising:

a base plate mountable for rotation about an axis of rotation and having an air flow opening therethrough;

a brush mounted on one side of said base plate and having a plurality of bristles extending therefrom;

a plurality of first air handling foils connected to the base plate opposite the side from which the bristles extend for forming an airstream directed therefrom; and a plurality of second air handling foils interspersed with said bristles for forming an inwardly directed air flow in response to rotation about the axis of rotation.

19. The gutter broom of claim 18 wherein the air flow opening is in the central portion of said base plate.

20. The gutter broom of claim 18, further comprising an air flow redirector for redirecting the inwardly directed air flow through the air flow opening of said base plate.

21. The gutter broom of claim 20, wherein said air flow redirector comprises a conical body of revolution having a narrow end and a wide end, the narrow end nearer the air flow opening than the wide end.

22. The gutter broom of claim 20, further comprising a spider plate spaced from the base plate to define air flow passages between the spider plate and the base plate, said air flow redirector connected to said spider plate.

23. The gutter broom of claim 18, wherein said second-mentioned air foils are connected to said base plate and depend therefrom.

24. The gutter broom of claim 23, wherein said second-mentioned air foils are defined by a curvilinear surface having a leading edge and a trailing edge, said trailing edge nearer the axis of rotation than the leading edge.

25. The gutter broom of claim 18, further comprising a fan housing surrounding said first-mentioned air handling foils and having an outlet through which the air flow is directed therefrom.

26. A gutter broom for a pavement sweeper comprising:

a mounting plate mountable for rotation about an axis of rotation;

a plurality of bristles extending from one side of said mounting plate; and a plurality of air foils interspersed with said bristles for forming an inwardly directed air flow low in response to rotation of the broom.

27. The gutter broom of claim 26 wherein said mounting plate has a central opening therethrough, whereby the inwardly directed air flow passes through the central opening in response to rotation of the gutter broom about the axis of rotation.

28. The gutter broom of claim 26, wherein said air foils are connected to said mounting plate and depend therefrom.

29. The gutter broom of claim 26, wherein said air foils are defined by a curvilinear surface having a leading edge and a trailing edge, said trailing edge nearer the axis of rotation than the leading edge.

30. The gutter broom of claim 26, further comprising a plurality of air handling blades connected to said mounting plate on the side opposite said air foils for directing the air flow therefrom.

31. The gutter broom of claim 30, further comprising a fan housing surrounding said air handling blades and having a outlet through which the air flow is directed.

* * * * *